United States Patent [19]

Binger

[11] Patent Number: 4,815,219

[45] Date of Patent: Mar. 28, 1989

[54] DISPOSABLE ATTACHMENT FOR PORTABLE HAIR DRYERS FOR DRYING DELICATE ITEMS OF WEARING APPAREL

[76] Inventor: Lucille M. Binger, P.O. Box 10, Gaston, Oreg. 97119

[21] Appl. No.: 211,144

[22] Filed: Jun. 22, 1988

Related U.S. Application Data

[63] Continuation of Ser. No. 110,649, Oct. 13, 1987, abandoned, which is a continuation of Ser. No. 875,637, Jun. 18, 1986, abandoned, which is a continuation-in-part of Ser. No. 830,283, Feb. 18, 1986, abandoned.

[51] Int. Cl.[4] ..... F28B 3/00; F26B 19/00

[52] U.S. Cl. ..... 34/22; 34/91; 428/35.5

[58] Field of Search ..... 34/91, 19, 243 R, 239, 34/20, 23, 22; 428/35, 134

[56] References Cited

U.S. PATENT DOCUMENTS 4,406,071 9/1983 Buchanan ..... 34/91

*Primary Examiner*—Henry A. Bennet

*Attorney, Agent, or Firm*—Marger & Johnson

[57] ABSTRACT

The invention relates to attachments for portable hair dryers for drying other than hair, and specifically to a flexible, inflatable attachment into which can be placed delicate items of apparel, which can then be attached to a portable hair dryer for directing heated air through and around these apparel items for the purpose of drying them in a short time.

6 Claims, 1 Drawing Sheet

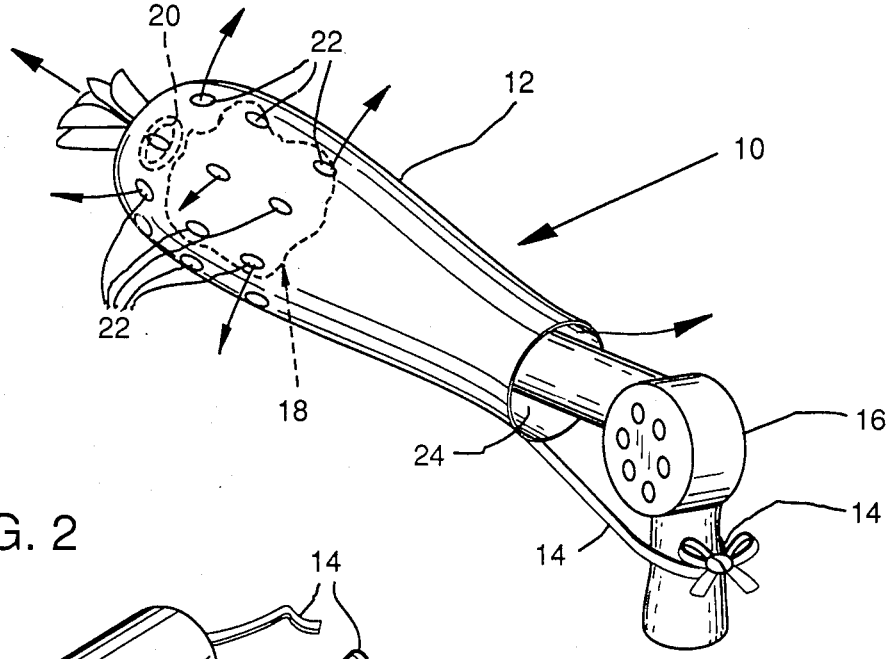
FIG. 1
FIG. 2
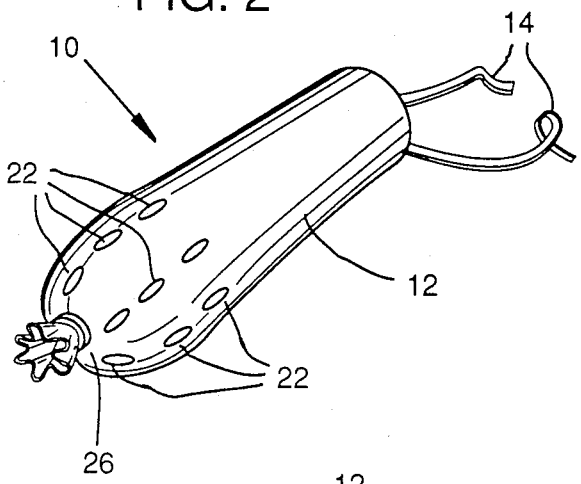
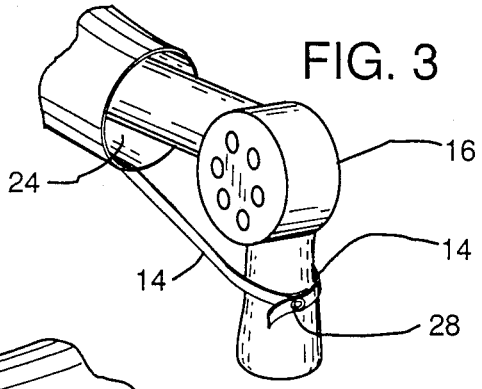
FIG. 3
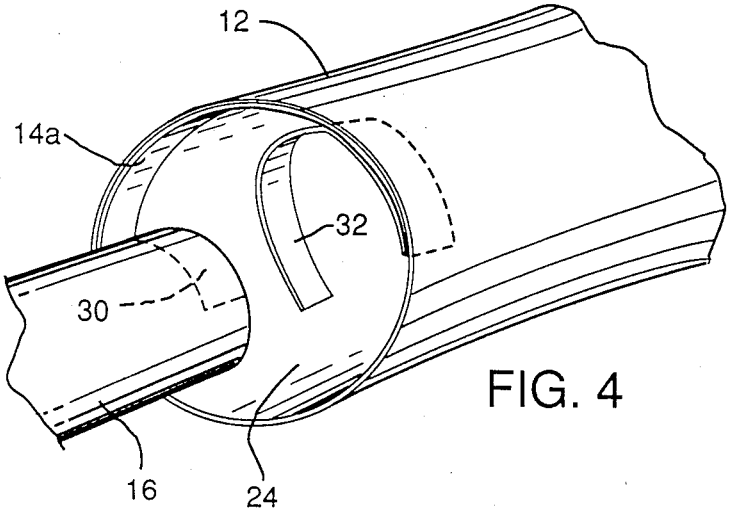
FIG. 4

DISPOSABLE ATTACHMENT FOR PORTABLE HAIR DRYERS FOR DRYING DELICATE ITEMS OF WEARING APPAREL

This application is a continuation of U.S. Application Ser. No. 110,649, filed Oct. 13, 1987 which is a continuation of U.S. Application Ser. No. 875,637 filed June 18, 1986, now abandoned, which was a continuation-in-part of U.S. Application Ser. No. 830,283 filed Feb. 18, 1986, now abandoned.

FIELD OF THE INVENTION

The present invention relates generally to attachments for portable hair drayers for drying other than hair, and specifically to a flexible, inflatable attachment into which can be placed delicate items of apparel, which can then be attached to a portable hair dryer for directing heated air through and around these apparel items for the purpose of drying them in a short time.

BACKGROUND OF THE INVENTION

This is a continuation-in-part application of U.S. patent application Ser. No 06/830,283 filed Feb. 18, 1986 by the same inventor as herein, entitled Disposable Attachment for Portable Hair Dryer for Drying Delicate Items of Wearing Apparel.

Travelers, especially women, who spend extended periods staying in hotels and motels that seldom have laundry facilities, nevertheless find it desirable each evening to wash delicate items of clothing such as stockings, pantyhose, lingerie and the like. The main concern of such travelers is that these garments be dry when travel is resumed. Since there are seldom drying facilities available, various subterfuges are resorted to, such as blowing the hot air from a hair dryer onto and through the garments as they are streched out on the shower rod, blotting up most of the unwanted moisture between turkish towels, hanging the garments in a doorway or in front of a window, or the like efforts. As anyone knows who has traveled extensively, none of these efforts is completely satisfactory.

Although no one has apparently invented such a device prior to the present invention, various efforts have been made to develop satisfactory drying devices for other purposes, using the heated air from Personal hair dryers or the like. Waters et al, U.S. Pat. No. 3,727,321 discloses an appliance with its own enclosed heater and blower, for drying wet hair. It includes a flexible manifold containing the blower and dryer for circulating heated air through ducts in the manifold which direct the air onto and through the hair.

Baslow U.S. Pat. No. 4,094,076 discloses a fixture to be attached to a portable hair dryer for directing heated air therefrom for the purpose of drying towels and other fabric articles draped over a perforated rod, through which the heated air is forced and from which the heated air passes through the fabric articles.

Hibino et al U.S Pat. No. 4,151,658 discloses a portable air heater and blower which is connected to an inflatable but porous bag which is placed between damp bed linens, for the purpose of drying said linens.

Sweetland U.S. Pat. No. 2,122,964 discloses a dryer for blowing heated air over a medical cast newly molded onto a broken or otherwise injured body member.

Finally, Yamac U.S. Pat. No. 4,524,263 discloses a travel iron which is heated by the hot air from a hair dryer temporarily attached thereto.

None of the foregoing disclosures reveals or suggests a perforated inflatable collapsible pouch attached to an air heater and blower, into which pouch or bag is placed delicate items of wearing apparel, for the purpose of drying said items by the heated air from the blower.

BRIEF DESCRIPTION OF THE PRESENT INVENTION

The present invention is an inflatable bag or pouch into which are placed damp items of delicate wearing apparel such as stockings, pantyhose, lingerie and the like. The bag can be adjustable, to control the amount of air flowing over and through the damp apparel. It is placed over the nozzle of an air heater and blower, such as a personal hair dryer, or the electric hand dryers sometimes found in public restrooms, and in hotel and motel rooms, whereupon the stream of heated air inflates the pouch and is forced into and through the damp apparel, drying it. In this preferred embodiment of the invention, a portion of the circumference of the mouth of the pouch is cemented to a portion of the external surface of the nozzle of the hair dryer.

The material of the bag is fabricated preferably of a heat resistant material which will inflate when the air from the dryer is forced through it. It can be of plastic or a synthetic or natural mesh or any other suitable material, such as a heat-resistant Mylar film. Preferably, it will have an opening in the end distant from the blower nozzle, and/or perforations in the body of the bag to permit the heated air to pass through the damp apparel, rather than just blow over the surface.

BRIEF DESCRIPTION OF THE DRAWINGS

FIG. 1 is an isometric view of the invention in use, placed over the nozzle of a personal hair dryer.

FIG. 2 is an isometric view of the inflatable pouch of the invention.

FIG. 3 is an enlarged view of one method of attaching the invention to a representative hair dryer.

FIG. 4 is an enlarged view of the preferred method of attaching the embodiment of the invention to a representative hair dryer.

DETAILED DESCRIPTION OF THE PRESENT INVENTION

FIG. 1 discloses the invention 10, including an inflatable bag 12, with loops 14 attached thereto for fastening the bag temporarily to personal hair dryer or other source of heated blown air 16. Damp items of delicate apparel 18 are inserted into the bag 12, where heated air from the dryer 16 is forced there-through and over them, evaporating the moisture there-from and expelling it through opening perforations 20, 22, and mouth 24. The opening 20 can have an adjustment means 26, e.g., rubber bands of different appropriate sizes or diameters, or an adjustable O-ring, to vary the size of the opening 20, so that adjustment can be made to accomodate for the relative sizes of the bag mouth 24 and the blower nozzle, and for different capacity blowers. The number, size and spacing of perforations 22 is determined by the volume of air to be passed therethrough, which in turn is determined by the size of the bag 12 and the quantity of items to be dried therein. The ratio of the size of the mouth of the bag to the size of the blower nozzle will determine how much air escapes through the mouth 24. This also can be compensated for by adjustment means 26.

The ties 14 can be long enough to accomodate different sizes and configurations of personal hair dryers. Another mode of use would be to fasten the bag 12 over the nozzle of the hot air blowers to be found in many public washrooms and in some hotel and motel rooms. Thus travelers who did not happen to have a personal hair dryer with them could still make use of the present invention in some circumstances.

The material of the pouch could be the aforementioned Mylar, or a mesh bag of some material. The primary consideration is that it not be flammable or deformable from the temperature of the heated air from the blower.

The fastening means 14 could simply be flexible ties which can be tied around the handle or other convenient part of the dryer as shown, or they could have plastic or metal snaps in the ends thereof.

In this preferred embodiment, the ties 14 could, in accordance with the teachings of this continuation-in-part application, be replaced by an adhesive material applied to a portion of the circumference of the mouth 24 of the pouch 12, which would stick to a portion 30 of the outside of the mouth of the nozzle of the source 16 of heated air. This adhesive material would be covered by a peel-off covering 32 to prevent it from adhering to inappropriate surfaces until it is desired to use the pouch 12 in accordance with the disclosure herein, and said material should be of a type which does not become permanent with heat, nor change significantly during the time it is used for the purposes described.

The invention as shown and described would be extremely economical to fabricate and manufacture, so much so that it would make a very attractive give-away item for hotels, motels, and other organizations involved in the travel industry. Small packages of them could be sold at low cost in stores for the convenience of travelers.

The terms and expressions which have been employed in the foregoing specification are used therein as terms of description, and not as terms of limitation, and there is no intention, in the use of such terms and expressions, of excluding equivalents of the features shown and described, or portions thereof it being recognized that the scope of the invention is defined and limited only by the claims which follow.

What I claim as my invention is:

1. An apparatus for drying damp items of apparel, comprising:

a hair dryer having a nozzle for emitting blown, heated air;

an inflatable elongate bag made of a heat-resistant flexible material, the bag having an open end defining a mouth located at one end of the bag, sized for receiving the items of apparel to be dried, and a closed end located at the end of the bag opposite said mouth, a plurality of small openings formed in the bag material adjacent the closed end of the bag, and sized to allow air to escape through the openings while retaining the apparel within the bag; and a strip of pressure-sensitive adhesive material extending along a portion of an interior surface of the bag material adjacent the mouth, detachably connecting the bag to an exterior surface of the nozzle, the nozzle being inserted into the mouth of the bag for directing the heated air toward the closed end to dry the apparel and the mouth of the bag being sized larger than the nozzle and open along one side of the nozzle to allow a portion of the air to escape from the bag around the nozzle.

2. An attachment for use in combination with a hair dryer to dry damp items of apparel, the hair dryer having a nozzle of a first circumferential size for emitting blown heated air, the attachment comprising:

an inflatable elongate bag made of heat-resistant, flexible material;

the bag having an open end defining a mouth for receiving the nozzle and a closed end defining a pouch at the opposite end of the bag to hold the items of apparel to be dried, a plurality of small openings in the material adjacent the closed end of the bag, sized to allow a portion of the heated air to escape while retaining the apparel within the pouch; and a strip of pressure-sensitive adhesive material connected circumferentially to the bag along an interior surface of the bag material adjacent the mouth for detachably connecting the bag to an exterior surface of the nozzle;

the mouth of the bag being sized to a second circumferential dimension greater than the size of the nozzle and the strip of adhesive material having a length less than the circumferential size of the nozzle for receiving the heated air through the mouth while allowing a selected portion of the air to escape from the bag around the nozzle.

3. The apparatus according to claim 1 further comprising a protective strip of material removably connected to the interior surface of the bag over the adhesive strip, sized to cover the adhesive strip, for covering the strip when not in use.

4. An apparatus according to claim 3 in which the bag material is a plastic film.

5. A method of drying damp items of apparel using a hair dryer having a nozzle of a first circumferential size, the method comprising:

a. providing an attachment for the hair dryer including the steps of forming a flexible, elongate bag of heatresistant material with an open end defining a mouth located at one end of the bag and a closed end defining a pouch at the opposite end of the bag;

sizing the mouth of the bag to a second circumferential size greater that the size of the nozzle for receiving the items of apparel to be dried;

forming a plurality of small openings in the material selectively in the closed end of the bag;

sizing said openings to allow air to escape while retaining the apparel within the pouch;

connecting a strip of pressure-sensitive adhesive material along an interior surface of the bag material circumferentially adjacent the mouth of the bag; and sizing the strip to a length less than the circumferential size of the nozzle;

b. inserting the damp items of apparel through the mouth into the bag;

c. positioning the mouth of the bag over the nozzle for receiving heated air through the mouth; and d. adhering the strip of adhesive material to a portion of the exterior surface of the nozzle to affix the bag material around a first portion of the mouth of the bag to the nozzle and to leave a second portion of the bag material detached from the nozzle to provide an opening alongside the nozzle.

6. The method of claim 5 further comprising:

activating the hair dryer so that heated air is blown through the nozzle into the bag;

releasing a portion of the heated air from the bag through the opening alongside the nozzle;

deactivating the hair dryer when the items of apparel are sufficiently dry;

peeling the adhesive strip off of the nozzle to separate the bag and the nozzle; and removing the items of apparel from the bag through the mouth.

* * * * *